United States Patent [19]

Okuyama

[11] Patent Number: 5,028,760

[45] Date of Patent: Jul. 2, 1991

[54] INFRARED HEATER

[75] Inventor: Shigeru Okuyama, Kashiwa, Japan

[73] Assignee: Senju Metal Industry, Co., Ltd., Tokyo, Japan

[21] Appl. No.: 323,927

[22] Filed: Mar. 15, 1989

[30] Foreign Application Priority Data

Mar. 15, 1988 [JP] Japan ..... 63-034023[U]

[51] Int. Cl.[5] ..... H05B 3/20; F24C 3/04

[52] U.S. Cl. ..... 392/435; 126/92 R; 165/133; 219/342; 219/530

[58] Field of Search ..... 219/339-358, 219/365, 377, 530, 540; 34/4; 126/92 R, 92 A, 92 C; 165/133

[56] References Cited

U.S. PATENT DOCUMENTS

| | | | |
|---|---|---|---|
| 3,539,770 | 11/1970 | Wallace | 219/342 X |
| 3,564,200 | 2/1971 | Governale et al. | 219/342 X |
| 3,604,894 | 9/1971 | Milligan | 219/347 X |
| 4,565,917 | 1/1986 | Furtek . | |
| 4,626,659 | 12/1986 | Charmes et al. | 219/343 |
| 4,798,192 | 1/1989 | Maruko | 126/92 AC X |

FOREIGN PATENT DOCUMENTS

| | | | |
|---|---|---|---|
| 2446444 | 9/1980 | France | 219/347 |
| 44-16225 | 7/1969 | Japan | 219/343 |
| 44-16226 | 7/1969 | Japan | 219/377 |
| 56-85619 | 7/1981 | Japan | 219/377 |
| 59-205531 | 11/1984 | Japan | 219/377 |
| 841913 | 7/1960 | United Kingdom | 219/377 |
| 850225 | 10/1960 | United Kingdom | 219/377 |
| 2201320 | 8/1988 | United Kingdom | 219/377 |

*Primary Examiner*—Anthony Bartis

*Attorney, Agent, or Firm*—Sughrue, Mion, Zinn, Macpeak & Seas

[57] ABSTRACT

An infrared electric panel heater includes an open side covered by a sintered or electroformed porous metallic panel. An electric sheathed heating element is installed in the housing in contact with the inner surface of the porous panel. The outer surface of the porous panel is substantially entirely covered with a ceramic layer, selected from the group consisting of $Al_2O_3$, $TiO_2$, $Cr_2O_3$, Mg O, $ZrO_2$, $SiO_2$ and mixture thereof, which emits far-infrared rays when heated.

4 Claims, 3 Drawing Sheets

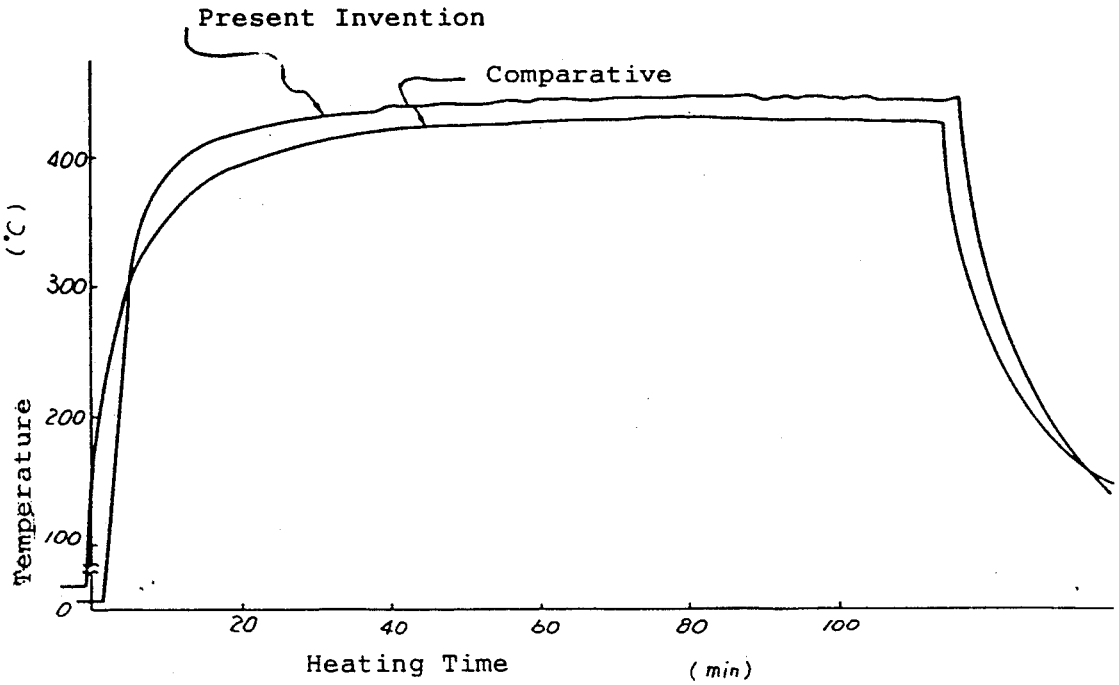
FIGURE 5
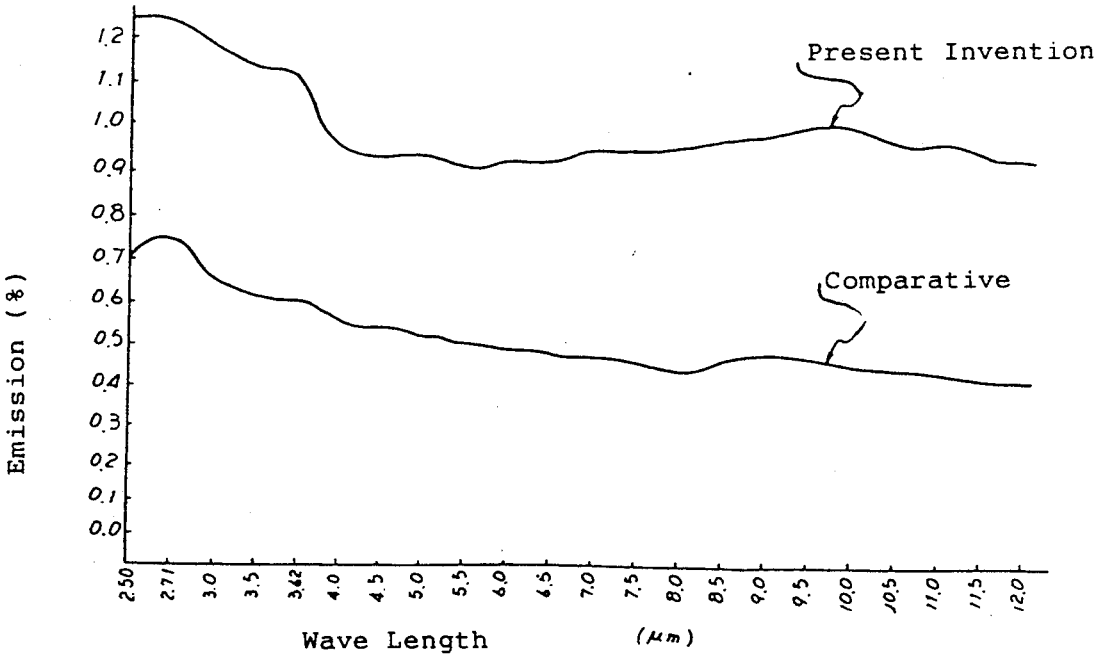

INFRARED HEATER

BACKGROUND OF THE INVENTION

The present invention relates to an infrared heater, and more particularly to an infrared heater which emits far-infrared rays having a way length of 4~25 μm for use in effecting reflowing of solder, curing of resins, drying of food, heating of wood an wet coatings, warming for medical treatment, and the like.

Recently, there is a general trend for electronic equipment to be made increasingly compact and lightweight. Accordingly, printed circuit boards having a large number of electronic parts mounted in a limited area (hereunder referred to as "high-density boards" or "high-density printed circuit boards") are widely used. In the manufacture of high-density boards, it is necessary to supply heat to a narrow area between electronic parts on the high-density board in order to reflow a paste solder or cure an adhesive resin when the electronic parts are connected to the circuit board using a paste solder or a resinous bonding agent. As an industrial heating apparatus for these purposes, a reflow furnace is used in which infrared heaters are placed on the top and bottom walls of a tunnel-type heating zone. The infrared heater used in the reflow furnace comprises a sheath heater and an infrared radiation panel made of a surface-treated stainless steel plate which is disposed over the sheath heater.

However, such conventional infrared heaters do not emit a sufficient amount of heat, so they must be operated at high power in order to thoroughly heat electronic parts on the board. This is not desirable from the viewpoint of economy, because the service life is very short when the heaters are operated at high power. Alternatively, a large-sized heater can be employed in order to increase the heat supply, but such a larger-sized heater is uneconomical because it requires an increase in the size of the reflow furnace.

SUMMARY OF THE INVENTION

An object of the present invention is to provide an infrared heater which can thoroughly heat narrow areas between electronic parts on high-density printed circuit boards, and which emits far-infrared rays which are easily absorbed by a paste solder or a bonding agent.

The inventor has found that the efficient production of heat can be achieved by a combination of an electric heating element with a porous metallic panel having a ceramic layer which is used as a radiation source of far-infrared rays and which can efficiently emit far-infrared rays when heated.

Thus, the present invention resides in an infrared heater comprising a housing, an electric heating element installed in the housing, and a porous sintered or electroformed metallic panel having a ceramic layer which can emit far-infrared rays when heated, the porous metallic panel being disposed in contact with the electric heating element.

The ceramic layer provided on the metallic panel can emit far-infrared rays which can efficiently heat objects. The porous metallic panel allows the heat from the electric heating element to pass therethrough and provides a large surface area which emits a large amount of heat.

BRIEF DESCRIPTION OF THE DRAWINGS

FIG. 4 is a graph showing the change in the surface temperature of an infrared-radiating body during heating;

FIG. 5 is a graph showing the change in the emission of far-infrared rays by the infrared-radiating body during heating;

DESCRIPTION OF THE PREFERRED EMBODIMENTS

Figure 1:
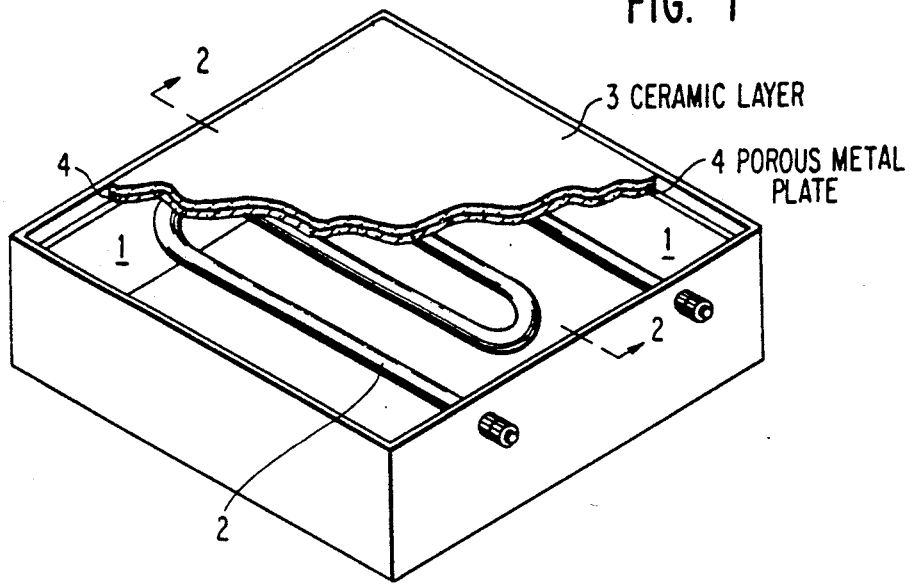
FIG. 1 is a cutaway perspective view of an infrared heater of the present invention.
Figure 2:
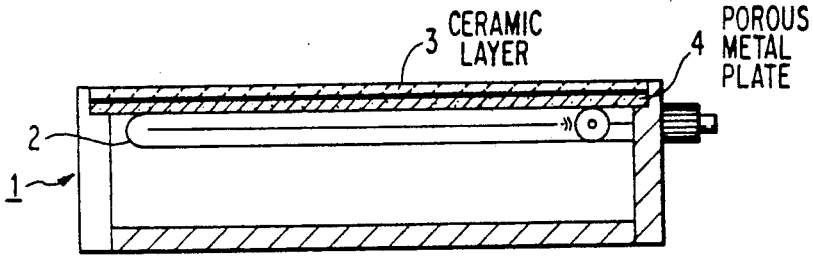
FIG. 2 is a cross-sectional view taken along line II—II of FIG. 1.

FIGS. 1 and 2 show an embodiment of an infrared heater of the present invention which includes a box-shaped housing 1, an electrical heating element 2, a ceramic layer 3, and a porous metallic panel 4.

As shown in FIGS. 1 and 2, the box-type housing 1 is provided with an opening which is covered by the porous metallic panel 4.

The porous metallic panel 4 may be made of any material which can emit far-infrared rays when heated. Examples of a suitable porous metallic panel 2 are a porous sintered metal plate which is produced by sintering metal powders, a perforated metal plate manufactured by electroforming (commercially available under the tradename of "Celmet"), a punched metal plate which is manufactured by mechanically punching a larger number of holes in a metal plate, or the like.

A ceramic layer may be placed on such metal plates so that they can emit far-infrared rays when heated. The ceramic layer which can emit far-infrared rays when heated can be mad of $Al_2O_3$, $TiO_2$, $Cr_2O_3$, MgO, $ZrO_2$, $SiO_2$, and the like.

The ceramic layer can be manufactured by means of baking or flame spraying a ceramic onto a porous metal plate.

In a preferred embodiment, in light of its functions as an infrared-radiating element, the porous metallic panel 4 comprises a perforated metal plate manufactured by electroforming and the ceramic layer 3 is applied thereto by flame spraying. According to this embodiment, the surface area of the panel 4 is large and the surface area of the ceramic layer is large and it can emit a large number of far-infrared rays. Therefore, paste solder can be heated and rapidly melted upon being heated with minimum thermal damage to electronic parts on the high-density printed circuit board.

The ceramic layer which is formed on the surface of the porous metallic panel and which constitutes a heating surface of the heater emits far-infrared rays having a wave length of 4~25 μm which can easily be absorbed by metallic or white-colored objects.

In the example shown in FIG. 1, the dimensions of the box-shaped housing 1 are 480 mm long×460 wide. The heating element 2 which is of the sheath type, i.e., sheath heater having a heating capacity of 4.4 kw is horizontally installed within the housing and has a zigzag shape. The heating element 2 comprises a sheath of stainless steel and an electrically heated wire inserted therein together with magnesia particles. The porous metallic panel 4 is placed in contact with the heating element 2. The panel 4 is manufactured by electroforming of an Ni-Cr alloy in an electrolytic bath. The ceramic layer 3, such as a $TiO_2$-$A_2lO_3$ ceramic layer, is provided by means of firing or flame spraying the ceramics.

Figure 3:
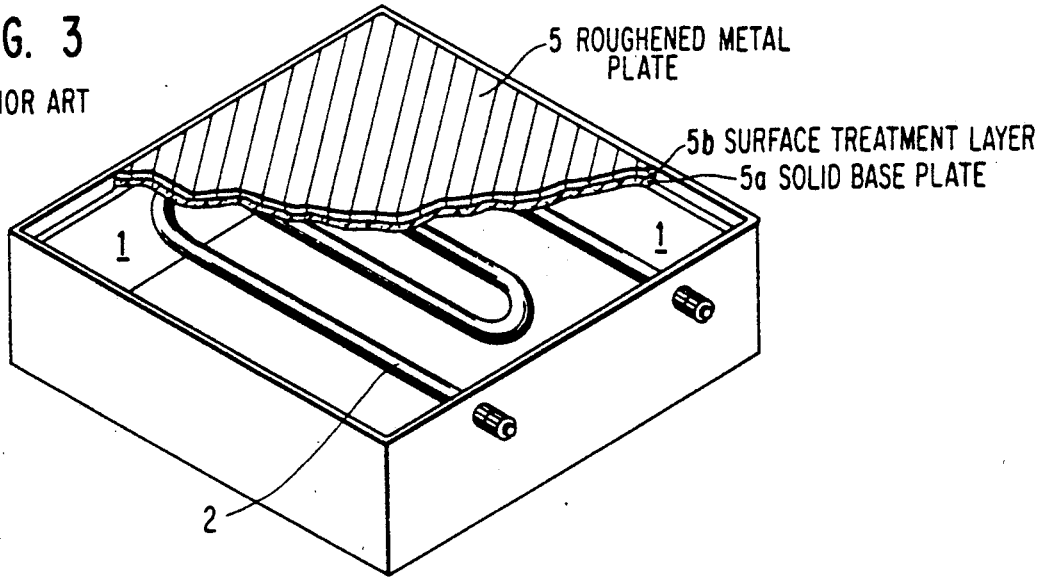
FIG. 3 PRIOR ART
FIG. 3 is a cutaway perspective view of a conventional example of an infrared heater.

In the comparative example shown in FIG. 3 the dimensions of the box-shaped housing 1 are 650 mm long×550 mm wide. The heating element 2 which has a heating capacity of 4 kw is horizontally installed within the housing and has a zigzag shape. A surface-treated plate 5 is provided on the electric heating element 2. The plate 5 comprises a stainless steel plate 5*a* which is chemically etched to give a roughened surface 5*b* which constitutes a radiating surface for an infrared heater used in conventional reflow furnaces.

The emission of far-infrared rays for the ceramic layer of FIG. 1 is nearly two times as high as that of the conventional surface-treated stainless steel plate 5 of FIG. 3. In addition, radiation heating is also carried out directly from the electric heating element 2 through the metallic panel 4. Thus, the infrared heater of the present invention has a very high heating efficiency and a large heating capacity, so it can heat objects efficiently and rapidly.

The operation of the infrared heater of the present invention as well as that of the metallic infrared heater of FIG. 3 will be described with reference to the drawings.

When an electric current is supplied to the electric heating element 2, the heating element 2 can heat the porous metallic panel 4 on stainless steel plate 5. Therefore, the heated ceramic layer 3 on top of panel 4 emits far-infrared rays, and the far-infrared rays are discharged from the front porous infrared-radiating panel 4. The heated stainless steel plate 5 also emits radiation heat from its roughened surface.

The changes in the surface temperatures of the porous metallic panel 4 and the stainless steel plate 5 during heating are shown graphically in FIG. 4. Other conditions including power supplied, and the like are adjusted so that the surface temperature is kept the same for each case, say about 400° C.

Far-infrared rays having a wave length of 4~25 μm which can be easily absorbed by metallic or white-colored objects are emitted from both the porous metallic panel 4 and the stainless steel plate 5 which are heated and maintained at around 400° C. by adjusting, for example, the supply of power to the electric heating element 2.

The radiation efficiency of the far-infrared rays having a wave length of 2.5~12 μm is determined for each case and are shown graphically in FIG. 5. As is apparent from FIG. 5, the radiation efficiency of the porous metallic panel 4, which acts as a supporting member of the ceramic layer, is about two times larger than that of the stainless steel plate 5. This is because, as mentioned before, the porous panel 4 can transmit radiating heat directly from the heating element 2 and it has a large surface area which can emit radiating heat.

Figure 6:
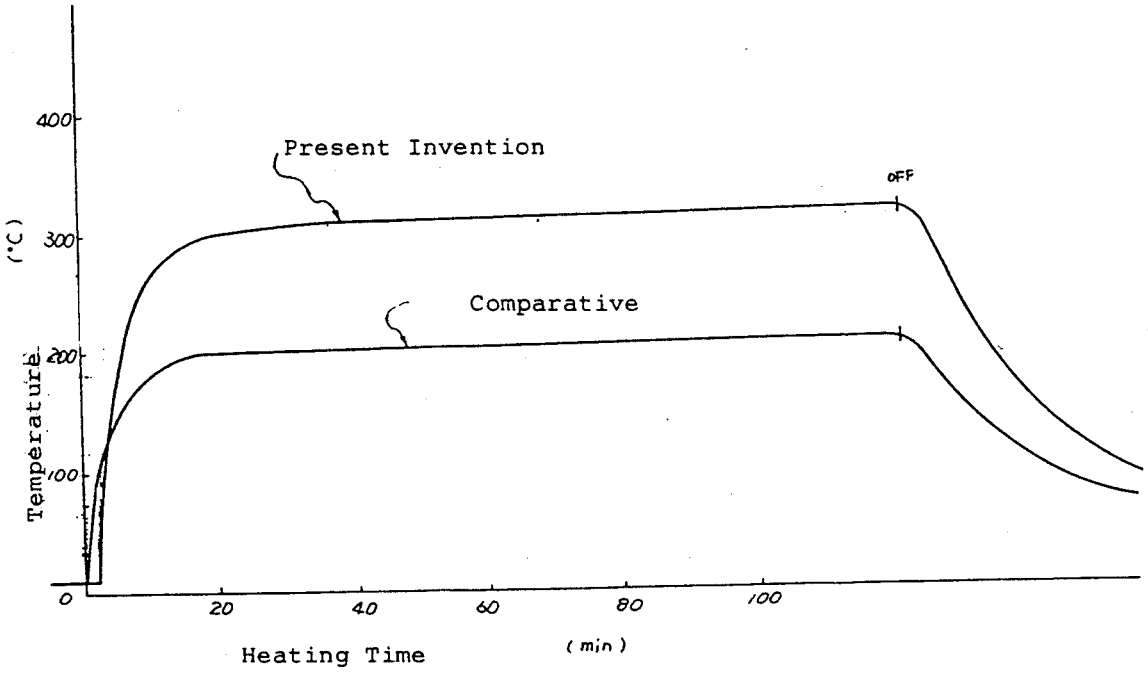
FIG. 6 is a graph showing the change in the surface temperature of an object being heated by an infrared heater.

Furthermore, the surface temperature during heating is determined for an object disposed 70 mm distant from the surface of the porous metallic panel 4 and the stainless steel plate 5. The heated object is an aluminum plate (thickness=4 mm, length=120 mm, width=120 mm). Changes in the measured surface temperature are shown by graphs in FIG. 6.

According to the present invention the surface temperature of the heated object is about 320° C., but for the comparative example, it is only 210° C.

As is apparent from the foregoing, the heating capacity of the heater of the present invention is much improved, e.g. by 100° C. higher than that of the conventional heater. This improvement is due to the radiation efficiency of far-infrared rays. Furthermore, as the melting point of paste solder is about 200° C. according to the present invention, it is possible to carry out reliable soldering of parts on a high-density board. In contrast, a conventional heater is not always able to melt paste solder completely.

Next, in order to confirm the amount of direct radiating heat generated by the present invention, an additional aluminum plate is inserted between the electric heater 2 and the porous metallic panel 4, and the temperature at a position 70 mm distant from the metallic panel is determined. The temperature is 320° C. without the provision of the aluminum plate, and is lowered to 240° C., i.e., about 80° C. lower than in the present invention, when the aluminum plate is used.

The present invention has been described primarily with respect to an example in which the infrared heater of the present invention is used as a heat source in a reflow furnace. However, as is apparent from the foregoing, the heater of the present invention is useful for a variety of other applications, including curing of resins, drying of food, heating of wood and wet coatings, and warming for medical treatment.

I claim:

1. An infrared panel heater comprising:

a housing having an opening in a side thereof;

an electric heating element installed in said housing;

and a porous metallic panel manufactured by sintering or electroforming to produce a three dimensional network structure, said panel covering said opening and having a ceramic layer on its outer surface, said ceramic layer covering substantially the entire outer surface of the metal panel which can emit far-infrared rays when heated, with a inner surface of the porous metallic panel being disposed in contact with the electric heating element.

2. An infrared panel heater as claimed in claim 1, wherein said housing is a box-shaped one.

3. An infrared heater as claimed in claim 1, wherein said porous metallic panel is made of a porous metallic plate manufactured by electroforming.

4. An infrared panel heater as claimed in claim 1, wherein said ceramic layer is made of a ceramic material selected from the group consisting of $Al_2O_3$, $TiO_2$, $Cr_2O_3$, MgO, $ZrO_2$, $SiO_2$, and mixtures thereof.

* * * * *